US009193032B2

(12) United States Patent
Chen et al.

(10) Patent No.: US 9,193,032 B2
(45) Date of Patent: Nov. 24, 2015

(54) SUPPLYING SYSTEM OF ADDING GAS INTO POLISHING SLURRY AND METHOD THEREOF

(71) Applicant: National Taiwan University of Science and Technology, Taipei (TW)

(72) Inventors: Chao-Chang Chen, Taipei (TW); Ping-Shen Chou, Taipei (TW); Wei-Kang Tu, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 0 days.

(21) Appl. No.: 14/251,603

(22) Filed: Apr. 13, 2014

(65) Prior Publication Data

US 2014/0308880 A1 Oct. 16, 2014

(30) Foreign Application Priority Data

Apr. 16, 2013 (TW) ..... 102113466 A

(51) Int. Cl.
*B24B 57/00* (2006.01)
*B24B 37/34* (2012.01)

(52) U.S. Cl.
CPC ..... *B24B 57/00* (2013.01); *B24B 37/34* (2013.01)

(58) Field of Classification Search
CPC ..... B24B 57/02; B24B 37/04; B24B 1/04; B24B 57/00; B24B 53/017
USPC ..... 451/60, 285–290, 446
See application file for complete search history.

(56) References Cited

U.S. PATENT DOCUMENTS

| | | | | | |
|---|---|---|---|---|---|
| 5,643,406 | A | * | 7/1997 | Shimomura et al. | 438/693 |
| 5,775,980 | A | * | 7/1998 | Sasaki et al. | 451/285 |
| 5,785,581 | A | * | 7/1998 | Settles | 451/99 |
| 5,797,789 | A | * | 8/1998 | Tanaka et al. | 451/289 |
| 5,866,480 | A | * | 2/1999 | Murakami et al. | 438/693 |
| 5,885,134 | A | * | 3/1999 | Shibata et al. | 451/41 |
| 5,958,268 | A | * | 9/1999 | Engelsberg et al. | 219/121.84 |
| 5,980,368 | A | * | 11/1999 | Chang et al. | 451/303 |
| 6,019,250 | A | * | 2/2000 | Pozniak et al. | 222/1 |
| 6,021,679 | A | * | 2/2000 | Li et al. | 73/863.23 |
| 6,106,375 | A | * | 8/2000 | Furusawa | 451/67 |
| 6,139,680 | A | * | 10/2000 | Chen et al. | 156/345.12 |
| 6,254,458 | B1 | * | 7/2001 | Julien | 451/41 |
| 6,257,965 | B1 | * | 7/2001 | Kamikubo et al. | 451/60 |
| 6,319,099 | B1 | * | 11/2001 | Tanoue et al. | 451/60 |
| 6,406,622 | B1 | * | 6/2002 | Tsuihiji et al. | 210/193 |

(Continued)

FOREIGN PATENT DOCUMENTS

| | | | |
|---|---|---|---|
| JP | S6339767 | A | 2/1988 |
| JP | 2000277467 | A | 10/2000 |

(Continued)

*Primary Examiner* — George Nguyen
(74) *Attorney, Agent, or Firm* — Mark M Friedman

(57) ABSTRACT

A supplying system of adding gas into the polishing slurry and method thereof are described. The supplying system includes a slurry container, a gas-mixed container, an adjusting device, a first flow controller, and a second flow controller. The supplying system utilizes the adjusting device to mix the polishing slurry with gas for forming the gas-mixed polishing slurry. The supplying system of adding the gas into the polishing slurry and method thereof are capable of increasing the material removal rate of the surface of the substrate in order to improve the processing quality of the substrate.

10 Claims, 3 Drawing Sheets

(56) References Cited

U.S. PATENT DOCUMENTS

| | | | | |
|---|---|---|---|---|
| 6,623,355 | B2 * | 9/2003 | McClain et al. | 451/60 |
| 6,872,128 | B1 * | 3/2005 | Pham et al. | 451/60 |
| 6,991,520 | B2 * | 1/2006 | Doy | 451/41 |
| 7,070,486 | B2 * | 7/2006 | Doi et al. | 451/60 |
| 7,189,146 | B2 * | 3/2007 | Basol et al. | 451/41 |
| 7,258,598 | B2 * | 8/2007 | Iwasaki et al. | 451/41 |
| 7,572,172 | B2 * | 8/2009 | Aoyama et al. | 451/60 |
| 8,002,607 | B2 | 8/2011 | Fukuda et al. | |
| 8,297,830 | B2 | 10/2012 | Tseng et al. | |
| 2002/0061722 | A1 * | 5/2002 | Kondo et al. | 451/446 |
| 2003/0100247 | A1 * | 5/2003 | Kim et al. | 451/60 |
| 2004/0060436 | A1 * | 4/2004 | Parekh et al. | 95/46 |
| 2004/0144722 | A1 * | 7/2004 | Zavattari et al. | 210/634 |
| 2004/0219867 | A1 * | 11/2004 | Gotkis et al. | 451/41 |
| 2014/0045409 | A1 * | 2/2014 | Zhang et al. | 451/2 |

FOREIGN PATENT DOCUMENTS

| | | | |
|---|---|---|---|
| JP | 2000340532 | A | 12/2000 |
| JP | 2002170792 | A | 6/2002 |
| JP | 2003251555 | A | 9/2003 |
| JP | 4994227 | B2 | 8/2012 |
| JP | 5157908 | B2 | 3/2013 |
| JP | 2013043239 | A | 3/2013 |
| TW | 571361 | B | 1/2004 |
| TW | I290507 | B | 12/2007 |

* cited by examiner

SUPPLYING SYSTEM OF ADDING GAS INTO POLISHING SLURRY AND METHOD THEREOF

FIELD OF THE INVENTION

The present invention relates to a supplying system of a polishing slurry and method thereof, and more particularly to a supplying system of adding gas into a polishing slurry and method thereof which are applicable to a planarization process apparatus to be used in a substrate.

BACKGROUND OF THE INVENTION

During a semiconductor process, such as a planarization process widely employing a chemical mechanical polishing (CMP) step used in a substrate, a constant loading is exerted on the substrate and the polishing pad for removing the substrate material based on the hydrodynamic effect when the polishing pad stably contacts the substrate by filling the polishing slurry therebetween. However, because the hardness of the substrate is too high, it takes longer processing time. Further, when such a surface reactive mechanism of the planarization process is employed to remove the material product on the surface of the substrate, it is required to properly determine the reaction abrasives disposed on the polishing pad so that the polishing process is quite complicated to consequently limit the yield rate of the semiconductor process. Particularly, since the planarization process consumes a lot of time, the wide use of the polishing slurry disadvantageously causes the environment pollution. Moreover, the development of the polishing slurry aims at a higher corrosion property for increasing the reaction capability to process the substrate, resulting in more negative environment side effect. Consequently, there is a need to develop a novel supplying method to solve the aforementioned problem.

SUMMARY OF THE INVENTION

One objective of the present invention is to provide a supplying system of adding gas into a polishing slurry and method thereof to improve the material removal rate of the substrate surface.

Another objective of the present invention is to provide a supplying system of adding gas into a polishing slurry and method thereof to for raising the polishing quality of the substrate and solving the problem of non-uniform surface.

According to the above objectives, the present invention sets forth a supplying system of adding gas into a polishing slurry and method thereof. In one embodiment, a supplying system of adding the gas into the polishing slurry, which is applicable to a planarization process apparatus for a substrate, for polishing the substrate, the supplying system comprises a slurry container, for storing the polishing slurry; a gas-mixed container connected to the slurry container, for receiving the polishing slurry; a gas container, for storing the gas and transporting the gas to the gas-mixed container; an adjusting device connecting the gas-mixed container to the gas container, for controlling the gas container to transport the gas with a predetermined flow rate to the gas-mixed container; and a first flow controller connected to the gas-mixed container, for controlling the gas-mixed container to output a gas-mixed polishing slurry into the planarization process apparatus to allow the planarization process apparatus for polishing the substrate by using the supplying system when the gas is dissolved in the polishing slurry to form the gas-mixed polishing slurry.

In one embodiment, based on the first pressure value P1 and the Henry's Law constant of the gas, the gas content of the gas in the gas-mixed polishing slurry of the gas-mixed container can be calculated. The first pressure value of the gas is greater than the second pressure value near the substrate so that when the gas flows near the substrate. The supplying system further includes a gas sensor connected to the gas-mixed container for sensing the gas content of the gas of the gas-mixed polishing slurry stored in the gas-mixed container.

In one embodiment, the gas is selected from one group consisting of oxygen, carbon dioxide, nitrogen and the combinations. The supplying system further includes a second flow controller connecting the gas-mixed container to the slurry container, for controlling a flow rate of the polishing slurry outputted from the slurry container to the gas-mixed container.

In another embodiment, a supplying method of adding a gas into a polishing slurry, which is applicable to a planarization process apparatus to be used in a substrate, for polishing the substrate, the method comprising the steps of: storing the polishing slurry by a slurry container; receiving the polishing slurry from the slurry container by a gas-mixed container; storing the gas and transporting the gas to the gas-mixed container by a gas container; controlling the gas container by an adjusting device for transporting the gas with a predetermined flow rate to the gas-mixed container; and controlling the gas-mixed container by a first flow controller for outputting a gas-mixed polishing slurry into the planarization process apparatus to allow the planarization process apparatus for polishing the substrate by using the supplying system when the gas is dissolved in the polishing slurry to form the gas-mixed polishing slurry.

The present invention provides a supplying system of adding gas into a polishing slurry and method thereof to improve the material removal rate of the substrate surface and raises the polishing quality of the substrate and solving the problem of non-uniform surface.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
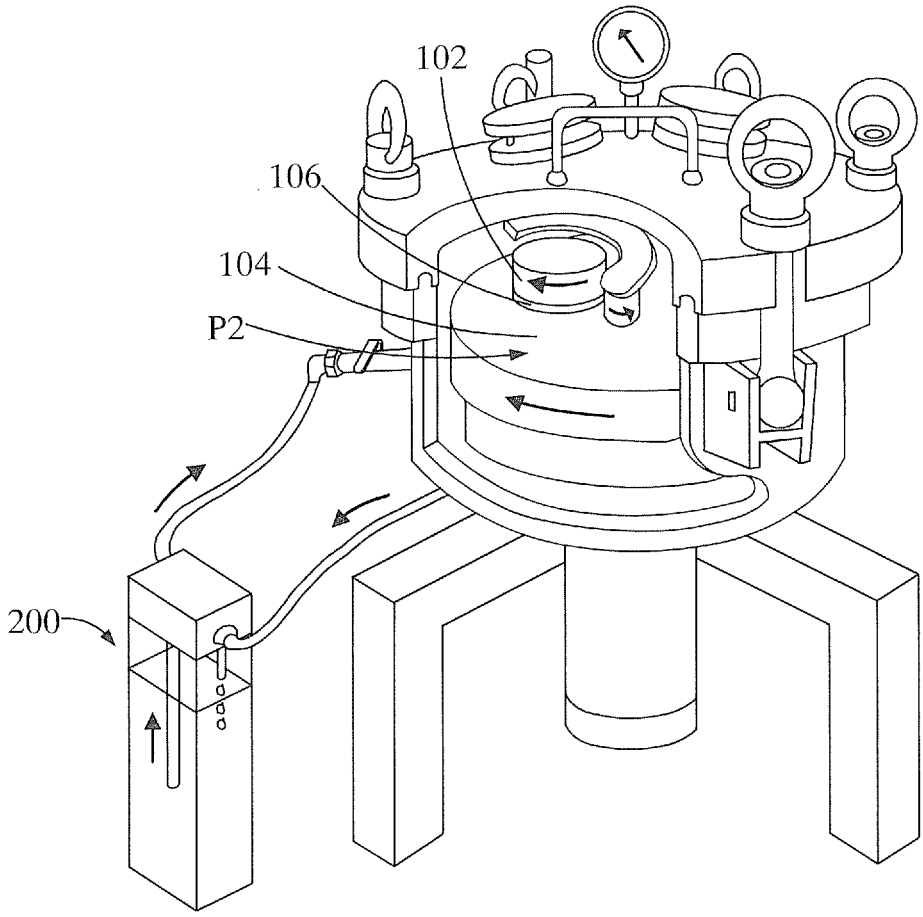
FIG. 1 is a schematic partial cross-sectional view of a planarization process apparatus having the gas-mixed polishing slurry according to one embodiment of the present invention.
Figure 2:
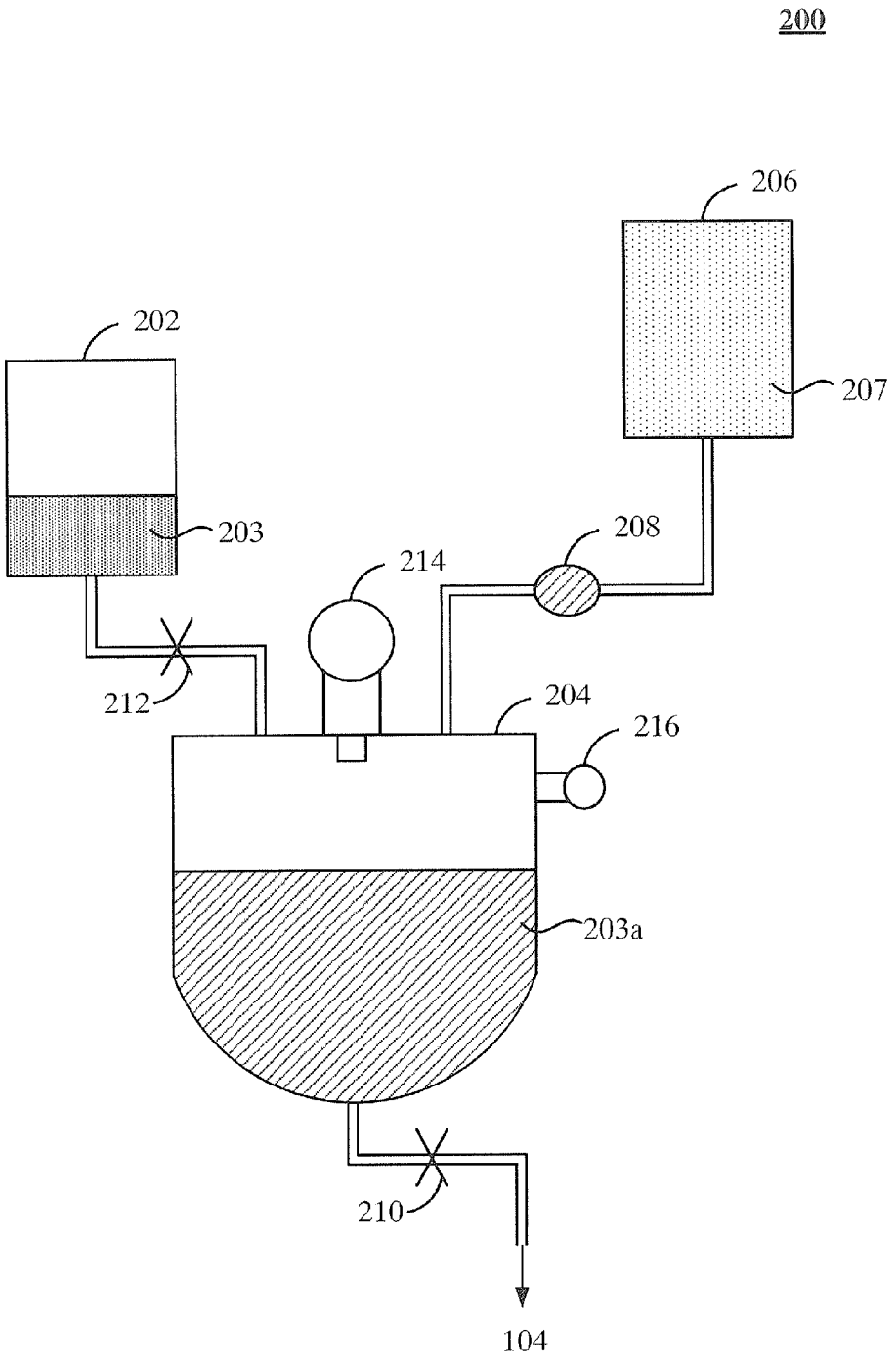
FIG. 2 is a schematic view of a supplying system of adding gas into the polishing slurry according to one embodiment of the present invention.

Referring to FIG. 1 and FIG. 2, FIG. 1 is a schematic partial cross-sectional view of a planarization process apparatus 100 having a supplying system 200 with the gas-mixed polishing slurry according to one embodiment of the present invention, and FIG. 2 is a schematic view of a supplying system 200 of adding gas into the polishing slurry according to one embodiment of the present invention. The supplying system 200 with the gas-mixed polishing slurry connects the planarization process apparatus 100 wherein the supplying system 200 adds the gas to the polishing slurry to be provided for the planarization process apparatus 100. When a polishing pad 104 on the polishing device 102 polishes the substrate 106, the gas-mixed polishing slurry is filled with the polishing pad 104 and the substrate 106 therebetween so that the polishing pad 104 is capable of performing a polishing procedure on the substrate 106 by using the gas-mixed polishing slurry. In one embodiment, the material of the substrate 106 may be lithium aluminum oxide ($LiAlO_2$, abbreviated as LAO) substrate, and/or silicon substrate. In another case, the material of the substrate 106 may be a substrate used in the semiconductor process.

Based on the Henry's Law, the solubility of the gas 207 in the liquid (e.g. the polishing slurry 203) of the supplying system 200 is positive and/or proportional to the partial pressure of the gas 207. When the pressure of the gas 207 is raised, the solubility of the gas 207 increases, which means that the solubility of the gas 207 is positively related to the pressure of the gas 207. This case can be described by following formula E1.

$$P=K*M \quad \text{(E1)}$$

where P represents the partial pressure of the solute (e.g. the gas 207) on the liquid (e.g. the polishing slurry 203), M represents the gas concentration dissolved in the liquid, and K represents the Henry's Law constant. According to the above-mentioned formula E1, the supplying system 200 of the present invention can calculate the solubility of the gas 207 dissolved in the polishing slurry 203 for controlling the polishing process of the substrate 106.

In FIG. 2, the supplying system 200 of adding the gas into the polishing slurry, which is applicable to a planarization process apparatus 100 to be used in a substrate 106 includes a slurry container 202, a gas-mixed container 204, a gas container 206, an adjusting device 208, a first flow controller 210 and a second flow controller 212.

In the supplying system 200, the slurry container 202 stores the polishing slurry 203. The gas-mixed container 204 is connected to the slurry container 202 for receiving the polishing slurry 203. The gas container 206 stores the gas 207 and transports the gas 207 to the gas-mixed container 204. The adjusting device 208 connects the gas-mixed container 204 to the gas container 206 for controlling the gas container 206 to transport the gas 207 with a predetermined flow rate to the gas-mixed container 204. The first flow controller 210 is connected to the gas-mixed container 204 for controlling the gas-mixed container 204 to output a gas-mixed polishing slurry 203*a* into the planarization process apparatus 100 to allow the planarization process apparatus 100 for polishing the substrate 206 by using the supplying system 200 when the gas 207 is dissolved in the polishing slurry 203 to form the gas-mixed polishing slurry 203*a*. In the supplying system 200 of the present invention, the gas-mixed container 204 reserves the gas-mixed polishing slurry 203*a* so that the gas 207 dissolved in the polishing slurry 203 is retained not to flow away advantageously before the gas-mixed polishing slurry 203*a* enters the polishing space of the planarization process apparatus 100.

In one embodiment, the supplying system 200 of the present invention further includes a second flow controller 212 connecting the gas-mixed container 204 to the slurry container 202 for controlling a flow rate of the polishing slurry from the slurry container 202 to the gas-mixed container 204. In other words, the second flow controller 212 controls the flow rate of the polishing slurry 203 to be transported to the gas-mixed container 204. In one preferred embodiment, the first flow controller 210 and the second flow controller 212 may be rotational flow rate controller to ensure the stability of the pressure, i.e. the first pressure value P1, of the gas 207 in the gas-mixed container 204.

In one embodiment, the supplying system 200 further includes a pressure gauge 214 connected to the gas-mixed container 204 for displaying a first pressure value P1 of the gas 207 stored in the gas-mixed container 204. Based on the first pressure value P1 and the Henry's Law constant of the gas 207, the gas content of the gas 207 in the gas-mixed polishing slurry 203*a* of the gas-mixed container 204 can be calculated. Specifically, by employing the above-mentioned formula E1, the gas content of the gas 207 is equal to the result of the first pressure value P1 divided by the Henry's Law constant corresponding to the gas 207. In one preferred embodiment, the first pressure value P1 of the gas 207 is greater than the second pressure value P2 near the substrate 106 so that when the gas flows near the substrate 106, the gas 207 rapidly separates out and precipitates and thus the precipitated gas is able to participate in the planarization process to polish the substrate 106. In another embodiment, the supplying system 200 further includes a gas sensor 216 connected to the gas-mixed container 204 for sensing the gas content of the gas 207 of the gas-mixed polishing slurry 203*a* stored in the gas-mixed container 204.

While the supplying system 200 with the gas-mixed polishing slurry adds the polishing slurry 203 to the planarization process apparatus 100, the gas 207 with unbalanced status within the gas-mixed polishing slurry 203*a* facilitates a large amount of gas to be precipitated from the gas-mixed polishing slurry 203*a* and the precipitated gas thus participates in the polishing planarization process of the substrate 106 since the first pressure value P1 of the gas-mixed container 204 is greater than the second pressure value P2 (e.g. one atmospheric pressure) near the substrate 106. When the gas 207 is selected as main reaction gas for the substrate 106 during the planarization process, the surface of the substrate 106 can immediately form a chemical reaction layer wherein the chemical reaction layer with removable characteristic may be easily stripped in comparison with the un-reaction material of the substrate 106 to increase the removal rate of the substrate 106. Therefore, the problem of non-uniform surface during the planarization process is solved.

In one embodiment, the gas 207 utilized in the supplying system 200 is selected from one group consisting of oxygen, carbon dioxide, nitrogen and the combinations. In the supplying system 200 of the planarization process apparatus 100, the process parameters and setting conditions corresponding to the process parameters are listed as the Table 1.

TABLE 1

| PROCESS PARAMETERS | SETTING CONDITIONS |
|---|---|
| Substrate material | lithium aluminum oxide substrate |
| Loading | 4.5 kg |
| Rotation velocity | 70 rpm |
| Flow rate of gas-mixed polishing slurry | 30 ml/min |
| Temperature of gas-mixed polishing slurry | 55° C. |
| Auxiliary gas | $O_2$, $CO_2$ |

Referring to Table 1, the present invention employs general polishing slurry, the substrate material is lithium aluminum oxide substrate or silicon substrate, the loading exerted on the substrate is 4.5 kg, the rotation velocity of the rotating disk receiving the substrate is 70 rpm, the flow rate of gas-mixed polishing slurry outputted to the polishing pad of the rotating disk is 30 ml/min, the temperature of gas-mixed polishing slurry is 55° C., and the auxiliary gases employed by the supplying system 200 are $O_2$ and/or $CO_2$. The experimental results are listed as the Table 2:

| Gas conditions | Original weight (g) | Weight after polishing (g) | Removed weight (g) | Processing time (mins) | Material removal rate (nm/min) | Surface roughness (nm) |
|---|---|---|---|---|---|---|
| Gas unused | 3.5050 | 3.4838 | 0.0212 | 30 | 133.1 | 1.42 |
| Used gas: $O_2$ | 3.4993 | 3.4701 | 0.0292 | 30 | 183.3 | 0.17 |
| Used gas: $CO_2$ | 3.4914 | 3.4643 | 0.0271 | 30 | 170.1 | 0.20 |
| Used gas: $N_2$ | 3.5009 | 3.4779 | 0.0230 | 30 | 145.5 | 0.17 |

Referring to Table 2, based on the experimental results, the oxygen, carbon dioxide, and nitrogen gases are regarded as active gases and results in forming the surface reaction resultants wherein the material removal rate are 183.3, 170.1 and 145.5 (nm/min) respectively, which are greater than the conventional material removal rate 133.1 (nm/min). Specifically, in comparison with the gas unused condition, the used gases of oxygen, carbon dioxide, and nitrogen in the present invention increase up to 37.7%, 28.8 and 9.3 respectively. In other words, when the removal weight of the substrate is taken as constant, the supplying method of adding at least one gas into the polishing slurry in the present invention employs the used gases of oxygen, carbon dioxide, and nitrogen advantageously decrease the consumption of the polishing slurry in comparison with the gas unused condition. In the aforementioned embodiment, the consumption of the polishing slurry decreases up to 37.7%, 28.8 and 9.3 respectively.

Moreover, during the process time in 30 minutes shown in the Table 2, the removed weight of the substrate is 0.0292 g, 0.0271 and 0.0230 g respectively while the used gases are oxygen, carbon dioxide, and nitrogen respectively, which are greater than the removed weight 0.0212 of conventional unused gas. Therefore, the supplying method of adding the gas into the polishing slurry in the present invention improves the material removal rate of the substrate surface while performing the polishing process of the lithium aluminum oxide substrate.

Furthermore, as shown in Table 2, while the oxygen, carbon dioxide, nitrogen are selected as reaction gases for the lithium aluminum oxide substrate, the surface roughness is 0.17 nm, 0.20 nm and 0.17 nm respectively, which are smaller than the surface roughness 1.42 nm of the conventional unused gas condition. That is, the supplying method of adding the gas into the polishing slurry in the present invention improves the surface roughness up to 5 through 8 times for raising the polishing quality of the substrate.

Specifically, in one case, while the oxygen gas is selected as auxiliary gas, the reaction formula of lithium aluminum oxide substrate to the oxygen gas as shown in formula E2. In another case, while the carbon dioxide gas is selected as auxiliary gas, the reaction formula of lithium aluminum oxide substrate to the carbon dioxide gas as shown in formula E3.

$$2LiAlO_2+H_2O \rightarrow 2LiOH+Al2O_3 \quad (E2)$$

$$4LiAlO_2+9H_2O+2CO_2 \rightarrow Li_2Al_4(CO_3)(OH)_{12}.3H_2O+Li_2CO_3 \quad (E3)$$

Based on the formula E2, the activity of the oxygen gas is greater to be easily reacted to the lithium and aluminum of the substrate so that the surface material of the lithium aluminum oxide substrate dissociates to increase the material removal rate.

Figure 3:
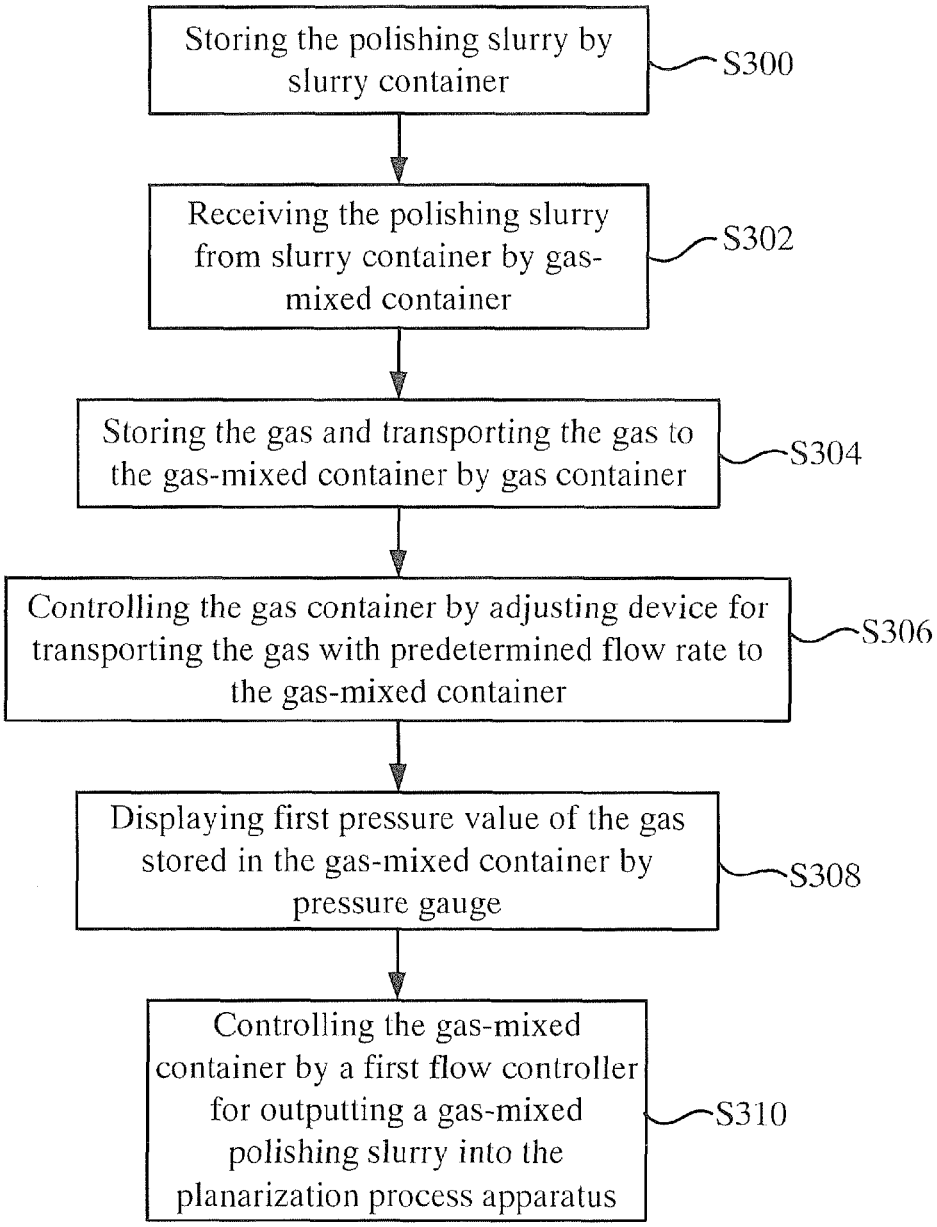
FIG. 3 is a flow chart of a supplying method of adding gas into the polishing slurry according to one embodiment of the present invention.

FIG. 3 is a flow chart of a supplying method of adding gas into the polishing slurry according to one embodiment of the present invention. The supplying system 200 of adding the gas into the polishing slurry, which is applicable to a planarization process apparatus 100 for a substrate 106 includes a slurry container 202, a gas-mixed container 204, a gas container 206, an adjusting device 208, a first flow controller 210, a second flow controller 212, a pressure gauge 214 and gas sensor 216. The supplying method of adding a gas into a polishing slurry includes the following steps.

In the step S300, the slurry container 202 stores the polishing slurry.

In the step S302, the gas-mixed container receives the polishing slurry from the slurry container. In one preferred embodiment, a second flow controller 212 connecting the gas-mixed container 204 to the slurry container 202 controls the flow rate of the polishing slurry 203 outputted from the slurry container 202 to the gas-mixed container 204.

In the step S304, a gas container 206 stores the gas 207 and transports the gas 207 to the gas-mixed container 204.

In the step S306, an adjusting device 208 controls the gas container 206 for transporting the gas 207 with a predetermined flow rate to the gas-mixed container 204.

In the step S308, a pressure gauge 214 connected to the gas-mixed container 204 displays a first pressure value P1 of the gas 207 stored in the gas-mixed container 204. Based on the first pressure value P1 and the Henry's Law constant of the gas 207, the gas content of the gas 207 in the gas-mixed polishing slurry 203*a* of the gas-mixed container 204 can be calculated. In one preferred embodiment, the first pressure value P1 of the gas 207 is greater than the second pressure value P2 near the substrate 106. In another embodiment, a gas sensor 216 senses the gas content of the gas-mixed polishing slurry 203*a* stored in the gas-mixed container 204.

In the step S310, the first flow controller 210 controls the flow rate of the gas-mixed container 204 to output a gas-mixed polishing slurry 203*a* into the planarization process apparatus 100 to allow the planarization process apparatus 100 for polishing the substrate 206 when the gas 207 is dissolved in the polishing slurry 203 to form the gas-mixed polishing slurry 203*a*.

According to the above-mentioned descriptions, the present invention provides a supplying system of adding gas into a polishing slurry and method thereof to improve the material removal rate of the substrate surface and raises the polishing quality of the substrate and solving the problem of non-uniform surface.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A supplying system of adding a gas into a polishing slurry, which is applicable to a planarization process apparatus to be used in a substrate, for polishing the substrate, the supplying system comprising:

a slurry container, for storing the polishing slurry;

a gas-mixed container connected to the slurry container, for receiving the polishing slurry;

a gas container, for storing the gas and transporting the gas to the gas-mixed container;

an adjusting device connecting the gas-mixed container to the gas container, for controlling the gas container to transport the gas with a predetermined flow rate to the gas-mixed container; and a first flow controller connected to the gas-mixed container, for controlling the gas-mixed container to output a gas-mixed polishing slurry into the planarization process apparatus to allow the planarization process apparatus for polishing the substrate by using the supplying system when the gas is dissolved in the polishing slurry to form the gas-mixed polishing slurry, wherein a solubility of the gas in the polishing slurry of the supplying system is positively related to a partial pressure of the gas in the polishing slurry, and the gas in the gas-mixed polishing slurry serves as main reaction gas for the substrate during the planarization process to increase a removal rate of the substrate.

2. The supplying system of claim 1, further comprising a pressure gauge connected to the gas-mixed container, for displaying a first pressure value of the gas stored in the gas-mixed container.

3. The supplying system of claim 1, further comprising a gas sensor connected to the gas-mixed container, for sensing a gas content of the gas-mixed polishing slurry stored in the gas-mixed container.

4. The supplying system of claim 1, wherein the gas is selected from one group consisting of oxygen, carbon dioxide, nitrogen and the combinations.

5. The supplying system of claim 1, further comprising a second flow controller connecting the gas-mixed container to the slurry container, for controlling a flow rate of the polishing slurry outputted from the slurry container to the gas-mixed container.

6. A supplying method of adding a gas into a polishing slurry, which is applicable to a planarization process apparatus to be used in a substrate, for polishing the substrate, the method comprising the steps of:

storing the polishing slurry by a slurry container;

receiving the polishing slurry from the slurry container by a gas-mixed container;

storing the gas and transporting the gas to the gas-mixed container by a gas container;

controlling the gas container by an adjusting device for transporting the gas with a predetermined flow rate to the gas-mixed container; and controlling the gas-mixed container by a first flow controller for outputting a gas-mixed polishing slurry into the planarization process apparatus to allow the planarization process apparatus for polishing the substrate by using the supplying system when the gas is dissolved in the polishing slurry to form the gas-mixed polishing slurry, wherein a solubility of the gas in the polishing slurry of the supplying system is positively related to a partial pressure of the gas the polishing slurry, and the gas in the gas-mixed polishing slurry serves as main reaction gas for the substrate during the planarization process to increase a removal rate of the substrate.

7. The supplying method of claim 6, further comprising a step of displaying a first pressure value of the gas stored in the gas-mixed container by a pressure gauge.

8. The supplying method of claim 6, further comprising a step of sensing a gas content of the gas-mixed polishing slurry stored in the gas-mixed container by a gas sensor.

9. The supplying method of claim 6, wherein the gas is selected from one group consisting of oxygen, carbon dioxide, nitrogen and the combinations.

10. The supplying method of claim 6, further comprising a step of controlling a flow rate of the polishing slurry outputted from the slurry container to the gas-mixed container by a second flow controller.

* * * * *